US010253610B2

(12) United States Patent
Roth et al.

(10) Patent No.: US 10,253,610 B2
(45) Date of Patent: Apr. 9, 2019

(54) DOWNHOLE OIL/WATER SEPARATION SYSTEM FOR IMPROVED INJECTIVITY AND RESERVOIR RECOVERY

(71) Applicant: Saudi Arabian Oil Company, Dhahran (SA)

(72) Inventors: Brian A. Roth, Dhahran (SA); Wessam A. Busfar, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 305 days.

(21) Appl. No.: 14/596,733

(22) Filed: Jan. 14, 2015

(65) Prior Publication Data

US 2015/0204181 A1 Jul. 23, 2015

Related U.S. Application Data

(60) Provisional application No. 61/930,018, filed on Jan. 22, 2014.

(51) Int. Cl.
*E21B 43/12* (2006.01)
*E21B 43/20* (2006.01)
(Continued)

(52) U.S. Cl.
CPC ..... *E21B 43/38* (2013.01); *E21B 43/128* (2013.01); *E21B 43/20* (2013.01); *E21B 43/385* (2013.01);
(Continued)

(58) Field of Classification Search
CPC ..... E21B 43/38; E21B 43/385
See application file for complete search history.

(56) References Cited

U.S. PATENT DOCUMENTS 3,137,344 A 6/1964 Wiemer
3,354,952 A 11/1967 Engle
(Continued)

FOREIGN PATENT DOCUMENTS

CN 102828736 A 12/2012
EP 1266122 12/2002
(Continued)

OTHER PUBLICATIONS

PCT Partial International Search Report; dated Mar. 27, 2015; International Application No. PCT/US2015/011353; International File Date: Jan. 14, 2015.
(Continued)

*Primary Examiner* — Blake E Michener
(74) *Attorney, Agent, or Firm* — Bracewell LLP; Constance G. Rhebergen; Linda L. Morgan

(57) ABSTRACT

A method and system for treating a hydrocarbon-bearing reservoir with a DOWS system includes forming a first and a second DOWS system wells that fluidly communicate with both a first and second hydrocarbon-bearing formation. The first well has an upflowing DOWS unit and the second well has a downflowing DOWS unit. The DOWS units separate production fluid into a water-rich fluid and a hydrocarbon-rich fluid that passes to the surface. Both wells have an injection zone and a production zone. The DOWS system is operated such that water-rich fluid from the first DOWS well is introduced into the first hydrocarbon-bearing formation, water-rich fluid from the second DOWS well is introduced into the second hydrocarbon-bearing formation, production fluid from the second hydrocarbon-bearing formation is introduced into the first DOWS well, and production fluid from the first hydrocarbon-bearing formation is introduced into the second DOWS well.

23 Claims, 2 Drawing Sheets

(51) Int. Cl.

| | |
|---|---|
| ***E21B 43/38*** | (2006.01) |
| ***E21B 47/00*** | (2012.01) |
| ***E21B 47/06*** | (2012.01) |
| ***F04B 47/00*** | (2006.01) |

(52) U.S. Cl.
CPC ..... *E21B 47/00* (2013.01); *E21B 47/06* (2013.01); *F04B 47/00* (2013.01)

(56) References Cited

U.S. PATENT DOCUMENTS

| | | | | |
|---|---|---|---|---|
| 4,078,608 | A | 3/1978 | Allen et al. | |
| 4,738,779 | A | 4/1988 | Carroll et al. | |
| 5,456,839 | A | 10/1995 | Chou | |
| 5,693,225 | A | 12/1997 | Lee | |
| 5,762,149 | A | 6/1998 | Donovan et al. | |
| 5,915,477 | A | 6/1999 | Stuebinger et al. | |
| 5,992,521 | A | 11/1999 | Bergren et al. | |
| 6,092,599 | A | 7/2000 | Berry et al. | |
| 6,213,208 | B1 | 4/2001 | Skilbeck | |
| 6,547,003 | B1 * | 4/2003 | Bangash ..... | E21B 43/40 166/106 |
| 6,845,821 | B2 | 1/2005 | Bouma et al. | |
| 7,814,976 | B2 | 10/2010 | Hackworth et al. | |
| 7,823,635 | B2 | 11/2010 | Wright et al. | |
| 8,261,821 | B2 | 9/2012 | Hackworth et al. | |
| 8,397,819 | B2 | 3/2013 | Tunget | |
| 8,505,627 | B2 | 8/2013 | Cox | |
| 2011/0079388 | A1 | 4/2011 | Cox | |

FOREIGN PATENT DOCUMENTS

| | | | |
|---|---|---|---|
| WO | 1998002637 | | 1/1998 |
| WO | 200123707 | A1 | 4/2001 |
| WO | 2012136064 | A1 | 10/2012 |

OTHER PUBLICATIONS

Jokhio, S. A., et al.; DOWS (Downhole Oil-Water Separation) Cross-Waterflood Economics; SPE/DOE Improved Oil Recovery Symposium held in Tulsa, OK; Apr. 13-17, 2002; Society of Petroleum Engineers, Inc.

"ARID: Aquifer Recharge Injection System", Big Cat Energy Corp., 2014, 4 pages.

* cited by examiner

DOWNHOLE OIL/WATER SEPARATION SYSTEM FOR IMPROVED INJECTIVITY AND RESERVOIR RECOVERY

CROSS-REFERENCE TO RELATED PATENT APPLICATIONS

This application claims priority from U.S. Provisional Application No. 61/930,018, filed Jan. 22, 2014. For purposes of United States patent practice, this application incorporates the contents of the Provisional Application by reference in its entirety.

BACKGROUND OF THE INVENTION

1. Field of the Invention

The field of invention relates to the production of subsurface crude oil deposits. More specifically, the field relates to a system and method for using downhole oil/water separation (DOWS) system for improving injectivity and use of formation water and for improving hydrocarbon recovery from a plurality of hydrocarbon-bearing formations.

2. Description of the Related Art

Downhole Oil/Water Separation (DOWS) systems that produce hydrocarbon fluids (crude oil, natural gas condensates) have been used in the field for nearly 20 years. Oil and gas industry engineers developed various technologies that separate hydrocarbons from water inside a well. If the entire process of lifting, treating, and reinjecting produced water can be avoided, costs and environmental impacts are likely to be reduced. The idea is that a hydrocarbon-rich fluid is produced to the surface while a water-rich stream is redirected and injected into an underground formation, for example, a second well leg or a non-hydrocarbon-bearing and porous part of the reservoir, without being lifted to the surface.

Management of produced water presents challenges and costs to operators and to the environment. Produced water is underground formation water that is brought to the surface along with crude oil, natural gas condensate, or natural gas. Typically, it is the largest (in volume) by-product or waste (depending how and if it is used in other processes) associated with oil and gas production. DOWS systems are intended to reduce the amount of water produced to surface in order to minimize the surface facility requirements for separating and treating water. Produced water separation, treatment and disposal per barrel of hydrocarbon fluid can be expensive given the amount of chemicals and additives required in addition to the on-site infrastructure—temporary or permanent—needed to process the water-laden hydrocarbon. The cost of managing produced water after it is already lifted to the surface and separated from the oil or gas product can range from less than $0.01 to more than several dollars per barrel. With a number of DOWS systems, production water can be reduced by up to 75% of the production water potentially produced to the surface without such a system in place.

Two basic types of DOWS systems are currently in use. One type of system uses a hydrocyclone to mechanically separate oil from water and direct the two products away from one another. The other type of DOWS system relies on gravity separation that takes place in the well bore. There is also a third type that potentially could be used—a membrane separation-based system—but there is not wide acceptance of this type of system given that the other two are well-established and proven technologies with known economic feasibility.

DOWS systems envision the use a single well in which an oil/water mixture was lifted to the DOWS system, fluid components separated out via either a hydrocyclone or gravity separation, and the water injected into a "suitable" formation that is different and not in fluid communication with the producing hydrocarbon-bearing formation except via the well.

DOWS systems, however, suffer from several systemic problems. Many DOWS systems are abandoned or are no longer performing to their full potential due to various factors. One reason may include plugging or low permeability at the injection zone for the formation that is to receive the production water (fines including sands, insoluble salts, minerals and clays; hydrocarbon residuum). The injection formation is typically in fluid contact with the well containing the DOWS system and is often a water-bearing formation or is a naturally permeable formation, such as sandstone. Another reason is having a high water cut, where the water fraction overwhelms the ability of the DOWS system to separate the hydrocarbons from the water effectively. Poor injection formation fluid isolation from the hydrocarbon-bearing formation can be fatal to a DOWS system. If isolation is not sufficient, the injectate (produced water) can migrate into the producing zone, thereby short-circuiting the produced hydrocarbon and formation water fluid flow pathway and re-entering the production perforations. This results in produced water recycle, and hydrocarbon production dropping to nearly zero. Corrosion and scale in the well bore annulus or casing surface can also be a major factor as this may clog the produced water flow pathway.

SUMMARY OF THE INVENTION

A Downhole Oil/Water Separation (DOWS) system that is operable for recovering a hydrocarbon-rich fluid from a plurality of hydrocarbon-bearing formations includes a first DOWS system well that has a first well bore wall that defines an interior, extends from a surface into a hydrocarbon-bearing reservoir such that it penetrates both a first hydrocarbon-bearing formation and a second hydrocarbon-bearing formation located within the hydrocarbon-bearing reservoir, has an upflowing DOWS unit located in the interior such that a portion of the well uphole from the DOWS unit is sealed from fluidly communicating with a portion of the well downhole from the DOWS unit, has an injection zone located uphole from the upflowing DOWS unit that is in fluid communication with both the first hydrocarbon-bearing formation and the upflowing DOWS unit, and has a production zone located downhole from the upflowing DOWS unit that is in fluid communication with both the second hydrocarbon-bearing formation and the upflowing DOWS unit. Each DOWS unit is operable to separate a production fluid into a water-rich fluid and the hydrocarbon-rich fluid. The DOWS system include a second DOWS system well that has a second well bore wall that defines an interior, extends from a surface into a hydrocarbon-bearing reservoir such that it penetrates both a first hydrocarbon-bearing formation and a second hydrocarbon-bearing formation located within the hydrocarbon-bearing reservoir, has a downflowing DOWS unit located in the interior such that a portion of the well uphole from the DOWS unit is sealed from fluidly communicating with a portion of the well downhole from the DOWS unit, has an injection zone located downhole from the downflowing DOWS unit that is in fluid communication with both the second hydrocarbon-bearing formation and the downflowing DOWS unit, and has a production zone located uphole from the downflowing DOWS unit that is in fluid communication with both the first hydrocarbon-bearing formation and the downflowing DOWS unit.

Each DOWS system well is operable to pass the hydrocarbon-rich fluid to the surface, to draw the production fluid from a hydrocarbon-bearing formation through the production zone and to inject the water-rich fluid into a hydrocarbon-bearing formation through the injection zone. Each hydrocarbon-bearing formation has a permeability.

The second hydrocarbon-bearing formation is not in fluid communication with first hydrocarbon-bearing formation except through the upflowing DOWS unit. The first hydrocarbon-bearing formation is not in fluid communication with second hydrocarbon-bearing formation except through the downflowing DOWS unit.

A method for producing from a hydrocarbon-bearing reservoir containing a hydrocarbon-rich fluid using a DOWS system includes the steps of operating the DOWS system such that a production fluid present in a production zone of a first DOWS system well is introduced into an upflowing DOWS unit, where the upflowing DOWS unit separates the production fluid into a water-rich fluid and the hydrocarbon-rich fluid, the water-rich fluid passes into an injection zone of the first DOWS system well and the hydrocarbon-rich fluid passes to a surface. The DOWS system is operated such that the production fluid present in the production zone of a second DOWS system well is introduced into a downflowing DOWS unit, where the downflowing DOWS unit separates the production fluid into the water-rich fluid and the hydrocarbon-rich fluid. The water-rich fluid passes into an injection zone of the second DOWS system well and the hydrocarbon-rich fluid passes to the surface. The DOWS system is operated such that the production fluid is produced into the production zone of the first DOWS system well from a second hydrocarbon-bearing formation and the water-rich fluid in the injection zone of the first DOWS system well is introduced into a first hydrocarbon-bearing formation. Te DOWS system is operated such that the production fluid is produced into the production zone of the second DOWS system well from the first hydrocarbon-bearing formation and the water-rich fluid in the injection zone of the second DOWS system well is introduced into the second hydrocarbon-bearing formation.

In alternate embodiments, the method can include monitoring a rate of introduction of the water-rich fluid into the first hydrocarbon-bearing formation, and adjusting a rate of introduction of the water-rich fluid into the second hydrocarbon-bearing formation. The difference between the rate of introduction of the water-rich fluid into the first hydrocarbon-bearing zone and the rate of introduction of the water-rich fluid into the second hydrocarbon-bearing zone can alternately be not significant. Each hydrocarbon-bearing formation has a permeability, and the difference between the permeability of the first hydrocarbon-bearing formation and the permeability of the second hydrocarbon-bearing formation can alternately be not significant.

In other alternate embodiments, the method can include the steps of monitoring a rate of production of the production fluid from a first hydrocarbon-bearing formation, and adjusting a rate of production of the production fluid from a second hydrocarbon-bearing formation. The difference between the production rate from the first hydrocarbon-bearing formation and the production rate from the second hydrocarbon-bearing formation can alternately be not significant. Each hydrocarbon-bearing formation has a permeability, and the difference between the permeability of the first hydrocarbon-bearing formation and the permeability of the second hydrocarbon-bearing formation is not significant.

In an alternate embodiment of the current disclosure, a method for forming a DOWS system operable to recover a hydrocarbon-rich fluid from a hydrocarbon-bearing reservoir includes the steps of forming a first DOWS system well that extends from a surface into a hydrocarbon-bearing reservoir such that it penetrates both a first hydrocarbon-bearing formation having a first permeability and a second hydrocarbon-bearing formation having a second permeability located within the hydrocarbon-bearing reservoir, where a first well bore wall defines the interior of the first DOWS system well. An upflowing DOWS unit is introduced into the first DOWS system well such that the first DOWS system has an injection zone that is in fluid communication with both the first hydrocarbon-bearing formation and the upflowing DOWS unit, has a production zone that is in fluid communication with both the second hydrocarbon-bearing formation and the upflowing DOWS unit, and the upflowing DOWS unit is located such that the portion of the interior uphole from the DOWS unit is sealed from fluid communication from the portion of the interior downhole from the DOWS unit. A second DOWS system well is formed that extends from a surface into a hydrocarbon-bearing reservoir such that it penetrates both the first hydrocarbon-bearing formation having the first permeability and the second hydrocarbon-bearing formation having the second permeability located within the hydrocarbon-bearing reservoir, where a second well bore wall defines the interior of the second DOWS system well. A downflowing DOWS unit is introduced into the second DOWS system well such that the second DOWS system has an injection zone that is in fluid communication with both the second hydrocarbon-bearing formation and the downflowing DOWS unit, has a production zone that is in fluid communication with both the first hydrocarbon-bearing formation and the downflowing DOWS unit, and the downflowing DOWS unit is production such that the portion of the interior uphole from the DOWS unit is sealed from fluid communication from the portion of the interior downhole from the DOWS unit. Each DOWS unit is operable to separate the production fluid into the water-rich fluid and the hydrocarbon-rich fluid.

In alternate embodiments, each hydrocarbon-bearing formation can have a permeability, and the difference between the permeability of the first hydrocarbon-bearing formation and the permeability of the second hydrocarbon-bearing formation can be not significant.

In yet another alternate embodiment of the current disclosure, a DOWS system that is operable for recovering a hydrocarbon-rich fluid from a plurality of hydrocarbon-bearing formations, the DOWS system includes a first DOWS system well. The first DOWS system: has a first well bore wall defines an interior, extends from a surface into a hydrocarbon-bearing reservoir such that it penetrates both a first hydrocarbon-bearing formation and a second hydrocarbon-bearing formation located within the hydrocarbon-bearing reservoir, has an upflowing DOWS unit located in the interior such that a portion of the well uphole from the DOWS unit is sealed from fluidly communicating with a portion of the well downhole from the DOWS unit; has an injection zone located uphole from the upflowing DOWS unit that is in fluid communication with both the first hydrocarbon-bearing formation and the upflowing DOWS unit; and has a production zone located downhole from the upflowing DOWS unit that is in fluid communication with both the second hydrocarbon-bearing formation and the upflowing DOWS unit. A second DOWS system well: has a second well bore wall defines an interior; extends from a surface into a hydrocarbon-bearing reservoir such that it penetrates both a first hydrocarbon-bearing formation and a second hydrocarbon-bearing formation located within the hydrocarbon-bearing reservoir; has an downflowing DOWS unit located in the interior such that a portion of the well uphole from the DOWS unit is sealed from fluidly communicating with a portion of the well downhole from the DOWS unit, where the DOWS unit is operable to separate a production fluid into the water-rich fluid and the hydrocarbon-rich fluid; has an injection zone located downhole from the downflowing DOWS unit that is in fluid communication with both the second hydrocarbon-bearing formation and the downflowing DOWS unit; and has a production zone located uphole from the downflowing DOWS unit that is in fluid communication with both the first hydrocarbon-bearing formation and the upflowing DOWS unit. Each DOWS system well is operable to pass the hydrocarbon-rich fluid to the surface, to draw the production fluid from a hydrocarbon-bearing formation through the production zone and to inject the water-rich fluid into a hydrocarbon-bearing formation through the injection zone. The DOWS unit is operable to separate a production fluid into a water-rich fluid and the hydrocarbon-rich fluid. Each hydrocarbon-bearing formation has a permeability. The second hydrocarbon-bearing formation is not in fluid communication with first hydrocarbon-bearing formation except through the upflowing DOWS unit, and the first hydrocarbon-bearing formation is not in fluid communication with second hydrocarbon-bearing formation except through the downflowing DOWS unit.

In alternate embodiments, the difference between the permeability of the first hydrocarbon-bearing formation and the permeability of the second hydrocarbon-bearing formation can be not significant.

In other alternate embodiments, the system can alternately include an electric submersible pump (ESP). The ESP can be located in the injection zone located downhole from the downflowing DOWS unit and can be operable to inject the water-rich fluid into the second hydrocarbon-bearing formation. Alternately, the ESP can be located in the injection zone located uphole from the upflowing DOWS unit and can be operable to inject the water-rich fluid into the first hydrocarbon-bearing formation. The ESP can alternately be located in the production zone located uphole from a DOWS unit and can be operable to pass hydrocarbon-rich fluid to the surface.

In yet other alternate embodiments, the system can include a control system. The control system can be operable to monitor a flow rate of the hydrocarbon-rich fluid produced from a DOWS system well. The control system can alternately be operable to monitor a flow rate of the water-rich fluid injected from a DOWS unit. Alternately, the control system can be operable to monitor a pressure within an injection zone for a DOWS system well. The control system can be operable to control the operation of an ESP and alternately the control system is operable to monitor a water quality of the hydrocarbon-rich fluid passed to the surface.

Although the difference between the first permeability and the second permeability is often not significant, the DOWS system is operable to function where there are significant differences in permeability of the multiple hydrocarbon-bearing formations serviced.

The method and system uses at least two adjacent wellbores. Each well extends through multiple hydrocarbon-bearing formations. Each well produces a production fluid made of a hydrocarbon/water mixture from one of the hydrocarbon-bearing formations but not the same formation. For example, a first well receives production fluid from a first hydrocarbon-bearing formation and a second well receives production fluid from a second hydrocarbon-bearing formation. Each well separates water from the received production fluid hydrocarbon/water mixture and introduces the water-rich fluid, which contains some to minimal hydrocarbons and possibly insolubles like sand, back into the hydrocarbon-bearing formation that the other well is using to produce production fluid. The amount of hydrocarbons in the water-rich fluid is less than about 500 ppm. By injecting the recovered water into the hydrocarbon-bearing formation from which a second well is drawing production fluid, the injected water acts as a reservoir sweeping fluid directed towards the second DOWS well. The injected water-rich fluid motivates the hydrocarbons in the hydrocarbon-bearing formation towards the other well. The combination of water-rich fluid and hydrocarbon-rich fluid forms production fluid. The separated hydrocarbons from both wells are produced to the surface as a product.

The method and system overcomes the limitations of previous single-well DOWS systems. Often, single-well DOWS systems suffer from plugging over time of the injection zones of the production water receiving formation due to incompatibilities with the injected fluids and the injection zone. The method and system also improves hydrocarbon recovery by using the DOWS system separated production water from each well to act as a secondary-recovery sweeping fluid for the hydrocarbon-bearing formation being serviced by the other DOWS system.

There are at least two hydrocarbon-bearing formations that are isolated from fluidly communicating with one another except through the DOWS system wells. The DOWS system and methods are not used in multiple portions of a single hydrocarbon-bearing formation. For a first hydrocarbon-bearing formation, the method and system provides continuous injection from an injection zone of at least one DOWS system well. The injected production water sweeps hydrocarbons through the first hydrocarbon-bearing formation to the production zone of at least one other DOWS system well. The opposite occurs with the second hydrocarbon-bearing formation: the injected production water from the other DOWS system wells sweeps hydrocarbons through the second hydrocarbon-bearing formation to the production zone of the at least one DOWS system well.

The DOWS system and method do not use aquifers within the hydrocarbon-bearing reservoir to either pull or produce a water-rich fluid (fresh water, salt water, brine, hydrocarbon-laden water). The DOWS system and method reintroduce water separated from the production fluid of a first hydrocarbon-bearing formation into a second hydrocarbon-bearing formation to facilitate water flooding in that second formation.

The DOWS system and method uses each and every DOWS well as both an in-situ water reinjection well and a hydrocarbon-rich fluid production well. The DOWS system and method does not include surface separations systems of hydrocarbon-rich fluid and water-rich fluid. The DOWS system and method also does not include surface re-injection of water-rich fluid recovered from prior hydrocarbon-rich fluid production.

The method and system is not limited to only a single pair of DOWS system wells. The method and system include multiple wells in a grid type pattern, where some DOWS system wells receive production fluid from a first hydrocarbon-bearing formation, separate the production fluid into produced water and product hydrocarbon-bearing fluid, and introduce the produced water into a second hydrocarbon-bearing formation, and the other DOWS system wells receive production fluid from the second hydrocarbon-bearing formation, separate the production fluid into produced water and product hydrocarbon-bearing fluid, and introduce the produced water into the first hydrocarbon-bearing formation. All of the DOWS system wells produce the hydrocarbon-rich fluid to the surface.

By forming a closed-loop production water system, where produced formation water from the first DOWS system well is used to sweep through the second hydrocarbon-bearing formation towards the second DOWS system well, less water is produced by both wells to the surface. The average amount of water produced to the surface using the DOWS system is reduced anywhere from about 85 vol. % to about 97 vol. % of the total water-rich fluid potentially produced to the surface when not using the described DOWS system. For example, for a production fluid from a first hydrocarbon-bearing formation having an 80% water cut, the amount of water reintroduced into the a second hydrocarbon-bearing formation as the sweeping fluid is in a range of from about 68 barrels to about 77 barrels of water-rich fluid per 100 barrels of production fluid produced. Avoiding handling this much water-rich fluid through surface systems or non-productive formations can reduce water handling costs anywhere from about 10% to about 25% of the costs of operating the wells.

Since the production water in the DOWS system is internally recycled through wells and hydrocarbon-bearing formations, the hydrocarbon-bearing formations should not become clogged or plugged with sand, salts, clays or residuum at the water injection zones. Each DOWS system well can separate and dispose of such particles before the water-rich fluid enters each hydrocarbon-bearing formation. Keeping water and insolubles downhole maximizes production of hydrocarbon-rich fluid and reduces energy costs of filtering, separating and sequestering such materials on the surface.

BRIEF DESCRIPTION OF THE DRAWINGS

These and other features, aspects, and advantages of the present invention are better understood with regard to the following Detailed Description of the Preferred Embodiments, appended Claims, and accompanying Figures, where:

Figure 1:
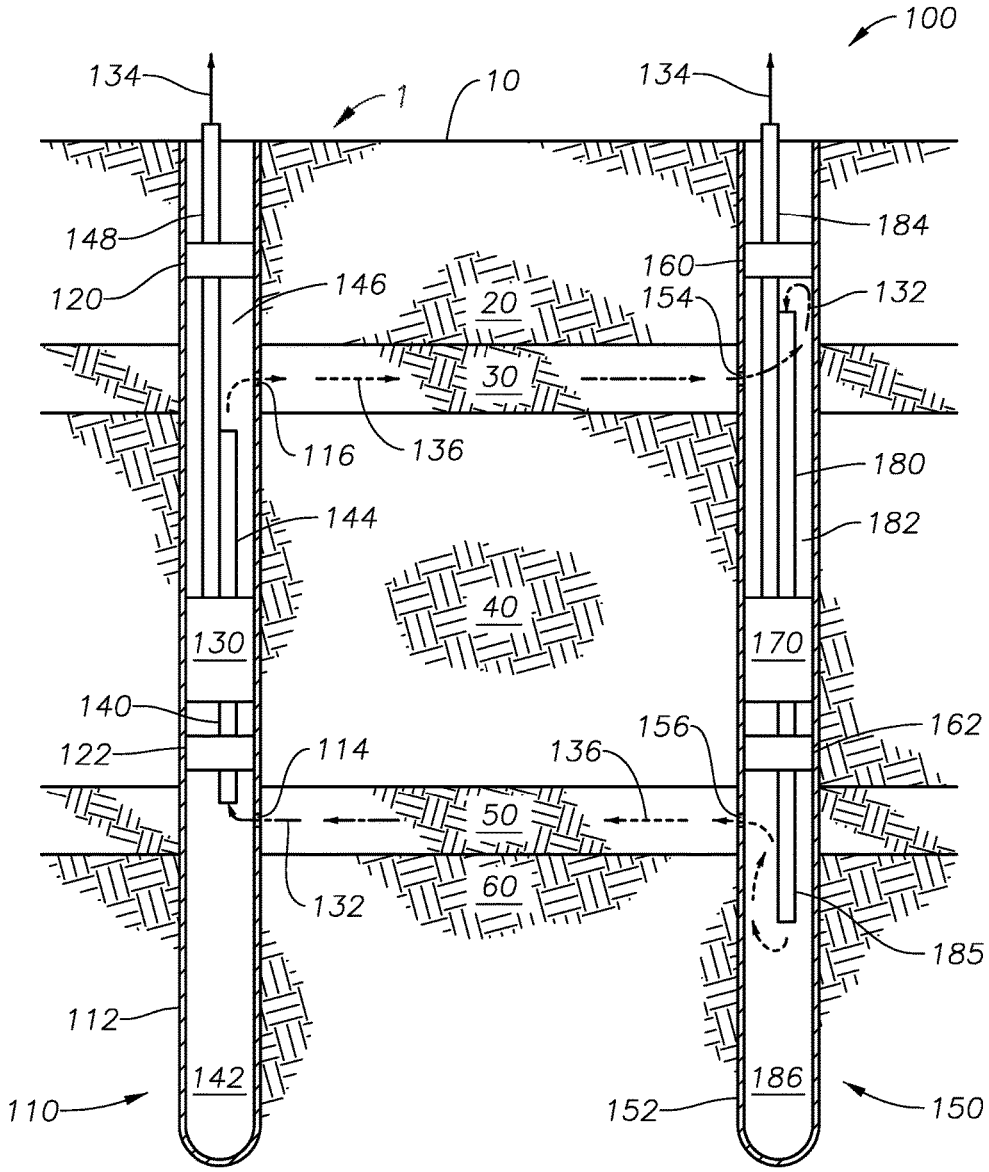
FIG. 1 is a general schematic of an embodiment of the DOWS system with two DOWS system wells.

The Figures are general schematics of embodiments of the DOWS system. The Figures and their description facilitate a better understanding of the DOWS system and its method of use. In no way should the Figures limit or define the scope of the invention. The Figures are simple diagrams for ease of description.

DETAILED DESCRIPTION OF THE PREFERRED EMBODIMENTS

The Specification, which includes the Summary of Invention, Brief Description of the Drawings and the Detailed Description of the Preferred Embodiments, and the appended Claims refer to particular features (including process or method steps) of the invention. Those of skill in the art understand that the invention includes all possible combinations and uses of particular features described in the Specification. Those of skill in the art understand that the invention is not limited to or by the description of embodiments given in the Specification. The inventive subject matter is not restricted except only in the spirit of the Specification and appended Claims.

Those of skill in the art also understand that the terminology used for describing particular embodiments does not limit the scope or breadth of the invention. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise.

As used in the Specification and appended Claims, the singular forms "a", "an", and "the" include plural references unless the context clearly indicates otherwise. The verb "couple" and its conjugated forms means to complete any type of required junction, including electrical, mechanical or fluid, to form a singular object from two or more previously non-joined objects. If a first device couples to a second device, the connection can occur either directly or through a common connector. "Optionally" and its various forms means that the subsequently described event or circumstance may or may not occur. The description includes instances where the event or circumstance occurs and instances where it does not occur. "Operable" and its various forms means fit for its proper functioning and able to be used for its intended use. "Associated" and its various forms means something connected with something else because they occur together or that one produces the other.

As used, the words "comprise," "has," "includes", and all other grammatical variations are each intended to have an open, non-limiting meaning that does not exclude additional elements, components or steps. Embodiments of the present invention may suitably "comprise", "consist" or "consist essentially of" the limiting features disclosed, and may be practiced in the absence of a limiting feature not disclosed. For example, it can be recognized by those skilled in the art that certain steps can be combined into a single step.

Spatial terms describe the relative position of an object or a group of objects relative to another object or group of objects. The spatial relationships apply along vertical and horizontal axes. Orientation and relational words including "uphole" and "downhole"; "upflowing" and "downflowing"; "above" and "below" and other like terms are for descriptive convenience and are not limiting unless otherwise indicated.

Where the Specification or the appended Claims provide a range of values, it is understood that the interval encompasses each intervening value between the upper limit and the lower limit as well as the upper limit and the lower limit. The invention encompasses and bounds smaller ranges of the interval subject to any specific exclusion provided. "Significant" means an amount that is functionally meaningful, or means equal to or greater than 10% by the indicated unit of measure.

Where reference is made in the Specification and appended Claims to a method comprising two or more defined steps, the defined steps can be carried out in any order or simultaneously except where the context excludes that possibility.

FIG. 1

FIG. 1 shows an embodiment of DOWS system 100 with two DOWS system wells in hydrocarbon-bearing reservoir 1. Hydrocarbon-bearing reservoir 1, starting from surface 10 downwards, includes overburden 20, first hydrocarbon-bearing formation 30, midburden 40, second hydrocarbon-bearing formation 50 and underburden 60. First hydrocarbon-bearing formation 30 and second hydrocarbon-bearing formation 50 are made of a porous rock that contains hydrocarbon fluids and formation water, which is water trapped in the formation with the hydrocarbon fluids. "Fluids" means vapors, liquids, gases and combinations thereof at the local present condition.

FIG. 1 shows first hydrocarbon-bearing formation 30, second hydrocarbon-bearing formation 50 and overburden 20, midburden 40 and underburden 60 in substantially horizontal alignment with one another, although in natural conditions portions of the reservoir including the formation may be at various angles to true horizontal. Fluids from first hydrocarbon-bearing formation 30 and second hydrocarbon-bearing formation 50 do not penetrate overburden 20, midburden 40 or underburden 60. First hydrocarbon-bearing formation 30 and second hydrocarbon-bearing formation 50 and are not in fluid communication with one another through midburden 40.

DOWS system 100 includes first DOWS system well 110. First DOWS system well 110 is defined by first well bore wall 112 and extends from surface 10 downward, penetrating overburden 20, first hydrocarbon-bearing formation 30, midburden 40, second hydrocarbon-bearing formation 50 and underburden 60. First DOWS system well 110 can be shaped vertical, horizontal, deviated, multi-branched, multi-tiered, and combinations thereof. First well bore wall 112 has perforations 114 at second hydrocarbon-bearing formation 50 to permit fluid communication between first DOWS system well 110 and first hydrocarbon-bearing formation 30. First well bore wall 112 also has perforations 116 at first hydrocarbon-bearing formation 30 to permit fluid communication between first DOWS system well 110 and second hydrocarbon-bearing formation 50.

First DOWS system well 110 contains several previously introduced pieces of equipment that define production and injection zones relative to the different hydrocarbon-bearing formations. Upper packer 120 is positioned within first DOWS system well 110 such that both first hydrocarbon-bearing formation 30 and second hydrocarbon-bearing formation 50 are downhole. Lower packer 122 is positioned within first DOWS system well 110 such that second hydrocarbon-bearing formation 50 is downhole. Upper packer 120 and lower packer 122 operate to prevent fluids from freely moving through first DOWS system well 110 by obstructing fluid flow, sealing the well at the well bore wall and being generally impervious to the fluid in the well bore.

Upflowing DOWS unit 130 is within and part of first DOWS system well 110. Upflowing DOWS unit 130 is physically positioned uphole of lower packer 122 and downhole of first hydrocarbon-bearing formation 30. Upflowing DOWS unit 130 is operable such that it draws in production fluid (long/short dashed arrow 132) from downhole of upflowing DOWS unit 130 and produces both hydrocarbon-rich fluid (solid arrow 134) and water-rich fluid (dashed arrow 136) that is discharged uphole of upflowing DOWS unit 130. Upflowing DOWS unit 130 is positioned and installed in first DOWS system well 110 such that fluid in the wellbore cannot bypass upflowing DOWS unit 130.

Upflowing DOWS unit 130 couples to fluid inlet tube 140 that traverses lower packer 122 such that upflowing DOWS unit 130 is in fluid communication with first production zone 142. First production zone 142 is also in fluid communication with second hydrocarbon-bearing formation 50 such that production fluid (long/short dashed arrow 132) flows through perforations 114. As shown in FIG. 1, the portion of first DOWS system well 110 that is part of first production zone 142 is the portion downhole from lower packer 122.

Upflowing DOWS unit 130 also couples to water-rich fluid outlet tube 144 such that upflowing DOWS unit 130 is in fluid communication with and discharges water-rich fluid into first injection zone 146. First injection zone 146 is also in fluid communication with first hydrocarbon-bearing zone 30 such that water-rich fluid (dashed arrow 136) flows through perforations 116. As shown in FIG. 1, the portion of first DOWS system well 110 that is part of first injection zone 146 is the portion downhole from upper packer 120 and uphole of upflowing DOWS unit 130.

Upflowing DOWS unit 130 also couples to hydrocarbon-rich fluid outlet tube 148 that traverses upper packer 120 such that upflowing DOWS unit 130 is in fluid communication with surface 10. Hydrocarbon-rich fluid (solid arrow 134) passes outside of DOWS system 100 for processing that is beyond the scope of this application.

DOWS system 100 includes second DOWS system well 150. Second DOWS system well 150 is defined by second well bore wall 152 and extends from surface 10 downward, penetrating overburden 20, first hydrocarbon-bearing formation 30, midburden 40, second hydrocarbon-bearing formation 50 and underburden 60. Second DOWS system well 150 can also be shaped vertical, horizontal, deviated, multi-branched, multi-tiered, and combinations thereof. Second well bore wall 152 has perforations 154 at first hydrocarbon-bearing formation 30 to permit fluid communication between second DOWS system well 150 and first hydrocarbon-bearing formation 30. Second well bore wall 152 also has perforations 156 at second hydrocarbon-bearing formation 50 to permit fluid communication between second DOWS system well 150 and second hydrocarbon-bearing formation 50.

First DOWS system well 110 is operable to fluidly communicate through first hydrocarbon-bearing formation 30 with second DOWS system well 150. Likewise, second DOWS system well 150 is operable to fluidly communicate through second hydrocarbon-bearing formation 50 with first DOWS system well 110. First DOWS system well 110 and second DOWS system well 150 are associated with one another.

Second DOWS system well 150 contains several previously introduced pieces of equipment—upper packer 160, lower packer 162—that are similar in nature and operation to upper packer 120 and lower packer 122 of first DOWS system well 110, respectively.

Downflowing DOWS unit 170 is within and part of second DOWS system well 150. Downflowing DOWS unit 170 is physically positioned in a similar position in second DOWS system well 150 as upflowing DOWS unit 130 is in first DOWS system well 110. Downflowing DOWS unit 170 is operable such that it draws in production fluid (long/short dashed arrow 132) and produces hydrocarbon-rich fluid (solid arrow 134) uphole of downflowing DOWS unit 170 and produces a water-rich fluid (dashed arrow 136) that is discharged downhole of downflowing DOWS unit 170.

Downflowing DOWS unit 170 couples to fluid inlet tube 180 such that downflowing DOWS unit 170 is in fluid communication with second production zone 182. Second production zone 182 is also in fluid communication with first hydrocarbon-bearing formation 30 such that production fluid (long/short dashed arrow 132) flows through perforations 154. As shown in FIG. 1, the portion of second DOWS system well 150 that is part of second production zone 182 is the portion downhole from upper packer 160 and uphole from downflowing DOWS unit 170.

Downflowing DOWS unit 170 also couples to hydrocarbon-rich fluid outlet tube 184 that traverses upper packer 160 in a similar manner and for similar results as hydrocarbon-rich fluid outlet tube 148 does with upper packer 120 for upflowing DOWS unit 130.

Downflowing DOWS unit 170 also couples to water-rich fluid outlet tube 185 such that Downflowing DOWS unit 170 is in fluid communication with and discharges water-rich fluid into second injection zone 186. Second injection zone 186 is also in fluid communication with second hydrocarbon-bearing formation 50 such that water-rich fluid (dashed arrow 136) flows through perforations 156. As shown in FIG. 1, the portion of second DOWS system well 150 that is part of second injection zone 186 is the portion below lower packer 162.

FIG. 2

Figure 2:
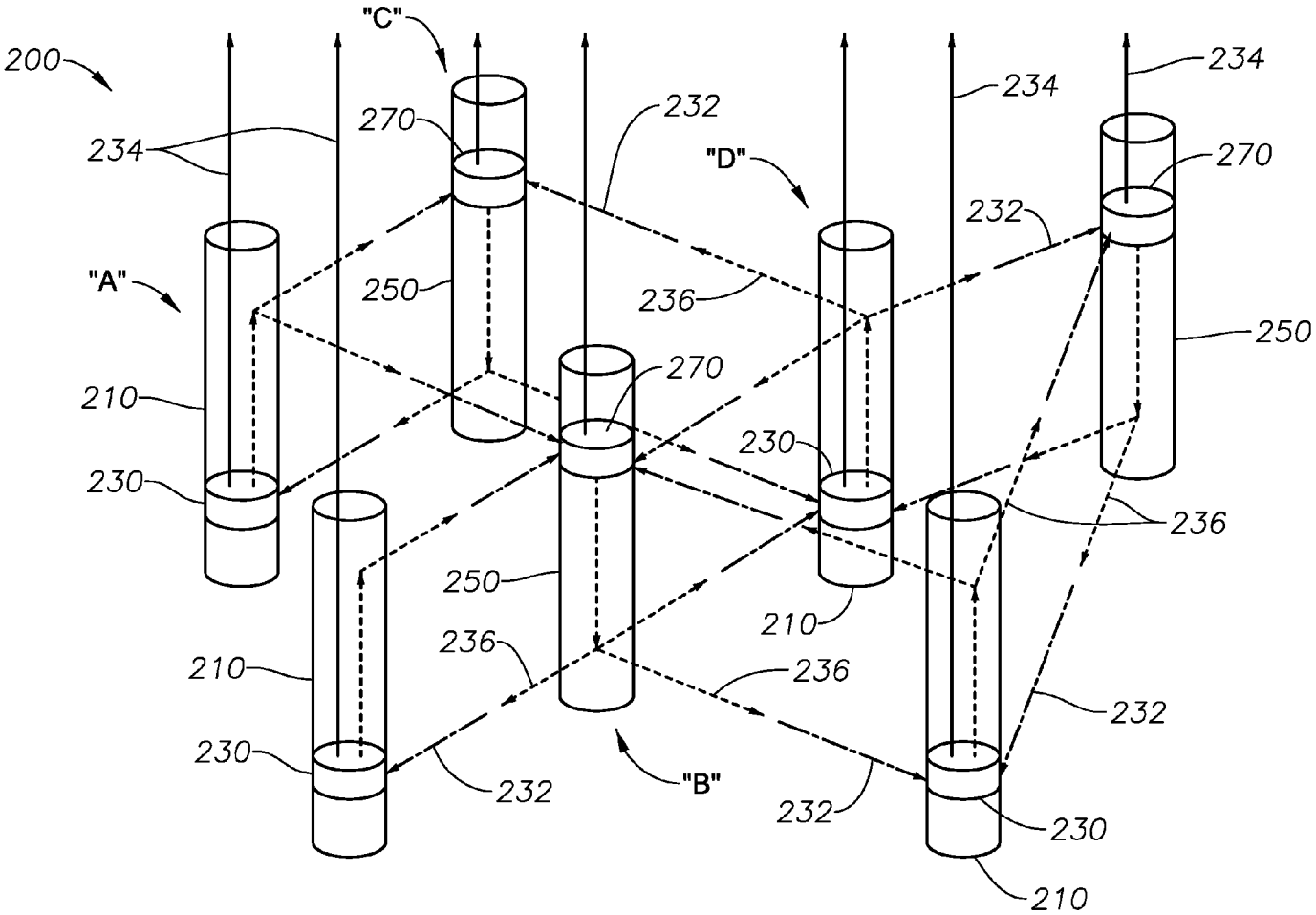
FIG. 2 is a general fluid flow schematic of an embodiment of the DOWS system with a plurality of DOWS system wells.

FIG. 2 is a general fluid flow schematic of an embodiment of DOWS system 200 with a plurality of DOWS system wells. FIG. 2 is similar to FIG. 1 except that it contains more first DOWS system wells 210 and second DOWS system wells 250. For the sake of improving clarity to FIG. 2, the formations and strata shown in FIG. 1 are removed as well as the tubing in each well. FIG. 2 shows the movement of water-rich fluid (dashed arrow 236) within and towards each of first DOWS system wells 210 and second DOWS system wells 250; production fluid (long/short dashed arrow 232) flowing into each of first DOWS system wells 210 and second DOWS system wells 250; and producing from each of first DOWS system wells 210 and second DOWS system wells 250 hydrocarbon-rich fluid (solid arrow 234) to the surface. Note that not all combinations of fluid flows are shown also for the sake of clarity.

Although some wells are not shown FIG. 2 to be directly associated with some other wells, all of the wells in FIG. 2 are in fluid communication with one another and therefore associated with one another. For example, DOWS system wells "A", with its upflowing DOWS unit 230, is in fluid communication with and is associated with the operation of DOWS system wells "B" and "C". DOWS system wells "A" injects water-rich fluid (dashed arrow 236) into an "upper" hydrocarbon-bearing formation results in the production of production fluid (long/short dashed arrow 232) into DOWS system wells "B" and "C". DOWS system wells "C", with its downflowing DOWS unit 270, processes production fluid (long/short dashed arrow 232) motivated from DOWS system wells "A" as well as from DOWS system wells "D", which also has an upflowing DOWS unit 230. DOWS system wells "C" produces a water-rich fluid and injects water-rich fluid (dashed arrow 236) into a "lower" hydrocarbon-bearing formation. Some of water-rich fluid (dashed arrow 236) produced by DOWS system wells "C" that is injected into the "lower" hydrocarbon-bearing formation not only moves towards DOWS system wells "D" but also back towards DOWS system wells "A". The acceptance of production fluid from a "lower" hydrocarbon-bearing formation and the injection of water-rich fluid into an "upper" hydrocarbon-bearing formation by first DOWS system wells 210 with upflowing DOWS unit 230 and vice versa by second DOWS system wells 250 with downflowing DOWS unit 270 continues until a fraction of the water-rich fluid (dashed arrow 236) injected by DOWS system wells "A" reaches the production zone of DOWS system wells "B". As well, the same can be said for a fraction of the water-rich fluid (dashed arrow 236) injected by DOWS system wells "B" and communicating with DOWS system wells "A".

Hydrocarbon-bearing Formation Permeability

The hydrocarbon-bearing formations used for injecting water-rich fluid and for producing production fluid should have a similar permeability to one another. Permeability of a formation is usually reported in units of millidarcys (mD), which is $10^{-12}$ $m^2$. Having similar permeability between the hydrocarbon-bearing formations used by the DOWS system allows for the water-rich fluid produced in each DOWS system well to not require a high injection pressure to push the fluid into the formation. In an embodiment of the system, the difference between the permeability of the first hydrocarbon-bearing formation and the permeability of the second hydrocarbon-bearing formation is not significant. In another embodiment of the system, the difference between the permeability of the first hydrocarbon-bearing formation and the permeability of the second hydrocarbon-bearing formation is significant.

Electric Submersible Pump (ESP)

If the difference in permeability between the first and the second hydrocarbon-bearing formations is significant, or if both formations are "tight" and have low permeability (from about 1 μD to about 0.5 mD), or there is a desire to meet an artificial hydrocarbon-rich fluid production rate (that is, a production rate that is higher than what the hydrocarbon-bearing formations can naturally produce), an optional electric submersible pump in fluid communication with the DOWS unit can elevate the pressure. In situations where the permeability difference is significant, the downhole pump can pressurize the water-rich fluid in the DOWS well that is introducing water-rich fluid into the lower-permeability hydrocarbon-bearing formation.

An embodiment of the system includes an electric submersible pump (ESP). In a further embodiment, the ESP is located in the injection zone located downhole from the downflowing DOWS unit and is operable to inject the water-rich fluid into the second hydrocarbon-bearing formation. In a further embodiment, the ESP is located in the injection zone located uphole from the upflowing DOWS unit and is operable to inject the water-rich fluid into the first hydrocarbon-bearing formation. Such pressurization of the water-rich fluid can compensate for the difference in permeabilities between the hydrocarbon-bearing formations being serviced by the DOWS system. In a further embodiment, the ESP is located in the production zone located uphole from a DOWS unit and is operable to pass hydrocarbon-rich fluid to the surface. The submersible water-rich pump can have multiple stages.

Control System

Optionally, the DOWS system can include a control system. Such a control system couples to each of the DOWS system wells through a series of sensors and electrical signal transmission lines. A control system coupling the several DOWS system wells is useful for monitoring the properties of the fluids and the operation of equipment within the DOWS system wells.

The control system can be a manual feedback system, where a signal representing a detected condition requires manual intervention with the computer controller to change the detected condition, or an automated system, where the detected condition signal is conveyed to an automated computer control system that responds according to a set of pre-determined instructions and requirements. An embodiment DOWS system includes a control system that uses a computer controller having pre-determined instructions (representing a computer program) and that is operable to receive a signal regarding a detected condition, to interpret the detected condition based upon a pre-determined requirement, and to change the operation of the DOWS system to fulfill the pre-determined requirement.

In conjunction with sensors monitoring process conditions, including temperature, flow rate, pressure and composition, the computerized control system can control the operation of the DOWS units and optional water-rich fluid submersible pumps based upon pre-programmed instructions for desired water-rich fluid and hydrocarbon-rich fluid properties, production fluid draw rate, and water-rich fluid injection for each DOWS well from as few as two DOWS wells to an array of DOWS wells as shown in FIG. 2.

An embodiment of the system includes a control system that is operable to monitor a flow rate of the hydrocarbon-rich fluid produced from a DOWS system well. An embodiment of the system includes a control system that is operable to monitor a flow rate of the water-rich fluid injected from a DOWS unit. An embodiment of the system includes a control system that is operable to monitor a pressure within an injection zone for a DOWS system well.

The control system is useful for maintaining various aspects of the operation of the DOWS system, including operation of each of the DOWS unit, the rate of introduction of the water-rich fluid into a hydrocarbon-bearing formation, the rate of producing production fluid from a hydrocarbon-bearing formation, and the discharge pressure of the optional water-rich submersible pump. An embodiment of the method includes monitoring the rate of introduction of the water-rich fluid into the first hydrocarbon-bearing formation, and adjusting the rate of introduction of the water-rich fluid into the second hydrocarbon-bearing formation by a second DOWS well. A further embodiment of the method includes where the difference between the rate of introduction of the water-rich fluid into the first hydrocarbon-bearing zone and the rate of introduction of the water-rich fluid into the second hydrocarbon-bearing zone is not significant. Such control can be demonstrated across a plurality of DOWS wells in a DOWS system. An embodiment of the method includes monitoring the total rate of introduction of water-rich fluid into a first hydrocarbon-bearing formation by a first set of DOWS wells and adjusting the total rate of introduction of water-rich fluid into a second hydrocarbon-bearing formation by a second set of DOWS well such that the difference between the total amount of water-rich fluid introduced at any given moment is not significant. The first set of DOWS wells contains one type of DOWS units—either upflowing or downflowing—and the second set contains the other type.

Control can also be exerted on a production fluid rate basis. An embodiment of the method includes monitoring a rate of production of the production fluid from a first hydrocarbon-bearing formation, and adjusting a rate of production of the production fluid from a second hydrocarbon-bearing formation. A further embodiment of the method includes where the difference between the production rate from the first hydrocarbon-bearing formation and the production rate from the second hydrocarbon-bearing formation is not significant. An embodiment of the method includes monitoring the rate of production fluid production from a first hydrocarbon-bearing formation by a first set of DOWS wells and adjusting the rate of production fluid production from a second hydrocarbon-bearing formation by a second set of DOWS well such that the difference between the total amount of production fluid produced is not significant.

The control system can also be useful in controlling aspects of the optional ESP for introducing water-rich fluid into a hydrocarbon-bearing formation or for passing hydrocarbon-rich fluid to the surface. An embodiment of the system includes where the control system is operable to control the operation of an ESP.

Supporting Equipment

Embodiments include many additional standard components or equipment that enables and makes operable the described apparatus, process, method and system.

Operation, control and performance of portions of or entire steps of a process or method can occur through human interaction, pre-programmed computer control and response systems, or combinations thereof.

What is claimed is:

1. A method for producing from a hydrocarbon-bearing reservoir containing a hydrocarbon-rich fluid using a Downhole Oil/Water Separation (DOWS) system, the method comprising the steps of:

operating the DOWS system such that a production fluid present in a production zone of a first DOWS system well is introduced into an upflowing DOWS unit, where the upflowing DOWS unit separates the production fluid into a water-rich fluid and the hydrocarbon-rich fluid, the water-rich fluid passes into an injection zone of the first DOWS system well and the hydrocarbon-rich fluid passes to a surface, wherein the upflowing DOWS unit is located entirely between a first upper packer and a first lower packer and couples to a first fluid inlet tube that extends downwards from the upflowing DOWS unit and traverses the first lower packer, wherein the hydrocarbon-rich fluid passes to the surface through a first hydrocarbon-rich outlet tube that extends from the surface directly to the upflowing DOWS unit and traverses the first upper packer so that the hydrocarbon-rich fluid remains within the first hydrocarbon-rich outlet tube after being separated from the water-rich fluid until the hydrocarbon-rich fluid passes to the surface and only the water-rich fluid is located in an annular space between the first lower packer and the first upper packer;

operating the DOWS system such that the production fluid present in the production zone of a second DOWS system well is introduced into a downflowing DOWS unit, where the downflowing DOWS unit separates the production fluid into the water-rich fluid and the hydrocarbon-rich fluid, the water-rich fluid passing into an injection zone of the second DOWS system well and the hydrocarbon-rich fluid passes to the surface, wherein the downflowing DOWS unit is located entirely between a second upper packer and a second lower packer and couples to a second fluid inlet tube that extends upwards from the downflowing DOWS unit such that only the production fluid is located in an annular space between the second upper packer and the second lower packer, wherein the hydrocarbon-rich fluid passes to the surface through a second hydrocarbon rich outlet tube that extends from the surface directly to the downflowing DOWS unit and traverses the second upper packer so that the hydrocarbon-rich fluid remains within the second hydrocarbon-rich outlet tube after being separated from the water-rich fluid until the hydrocarbon-rich fluid passes to the surface, and wherein the second lower packer circumscribes a second water-rich outlet tube and the second upper packer circumscribes the second hydrocarbon-rich outlet tube;

operating the DOWS system such that the production fluid is produced into the production zone of the first DOWS system well from a second hydrocarbon-bearing formation and the water-rich fluid in the injection zone of the first DOWS system well is introduced into a first hydrocarbon-bearing formation; and operating the DOWS system such that the production fluid is produced into the production zone of the second DOWS system well from the first hydrocarbon-bearing formation and the water-rich fluid in the injection zone of the second DOWS system well is introduced into the second hydrocarbon-bearing formation.

2. The method of claim 1 further comprising the steps of monitoring a rate of introduction of the water-rich fluid into the first hydrocarbon-bearing formation, and adjusting a rate of introduction of the water-rich fluid into the second hydrocarbon-bearing formation.

3. The method of claim 2 where the difference between the rate of introduction of the water-rich fluid into the first hydrocarbon-bearing zone and the rate of introduction of the water-rich fluid into the second hydrocarbon-bearing zone is not significant.

4. The method of claim 3 where each hydrocarbon-bearing formation has a permeability, and the difference between the permeability of the first hydrocarbon-bearing formation and the permeability of the second hydrocarbon-bearing formation is not significant.

5. The method of claim 1 further comprising the steps of monitoring a rate of production of the production fluid from the first hydrocarbon-bearing formation, and adjusting a rate of production of the production fluid from the second hydrocarbon-bearing formation.

6. The method of claim 5 where the difference between the production rate from the first hydrocarbon-bearing formation and the production rate from the second hydrocarbon-bearing formation is not significant.

7. The method of claim 6 where each hydrocarbon-bearing formation has a permeability, and the difference between the permeability of the first hydrocarbon-bearing formation and the permeability of the second hydrocarbon-bearing formation is not significant.

8. A method for forming a Downhole Oil/Water Separation (DOWS) system operable to recover a hydrocarbon-rich fluid from a hydrocarbon-bearing reservoir, the method comprising the steps of forming a first DOWS system well that extends from a surface into a hydrocarbon-bearing reservoir such that it penetrates both a first hydrocarbon-bearing formation having a first permeability and a second hydrocarbon-bearing formation having a second permeability located within the hydrocarbon-bearing reservoir, where a first well bore wall defines the interior of the first DOWS system well;

introducing an upflowing DOWS unit into the first DOWS system well such that the first DOWS system has an injection zone that is in fluid communication with both the first hydrocarbon-bearing formation and the upflowing DOWS unit, has a production zone that is in fluid communication with both the second hydrocarbon-bearing formation and the upflowing DOWS unit, and the upflowing DOWS unit is located such that the portion of the interior uphole from the upflowing DOWS unit is sealed from fluid communication from the portion of the interior downhole from the upflowing DOWS unit such that fluid in the first well bore cannot bypass the upflowing DOWS unit, and where the upflowing DOWS unit couples to a first fluid inlet tube that extends downwards from the upflowing DOWS unit and traverses a first lower packer;

introducing a first hydrocarbon-rich outlet tube that extends from the surface directly to the upflowing DOWS unit, the first hydrocarbon-rich outlet tube being circumscribed by a first upper packer;

forming a second DOWS system well that extends from the surface into the hydrocarbon-bearing reservoir such that it penetrates both the first hydrocarbon-bearing formation having the first permeability and the second hydrocarbon-bearing formation having the second permeability located within the hydrocarbon-bearing reservoir, where a second well bore wall defines the interior of the second DOWS system well; and introducing a downflowing DOWS unit into the second DOWS system well such that the second DOWS system has an injection zone that is in fluid communication with both the second hydrocarbon-bearing formation and the downflowing DOWS unit, has a production zone that is in fluid communication with both the first hydrocarbon-bearing formation and the downflowing DOWS unit, and the downflowing DOWS unit is located such that the portion of the interior uphole from the downflowing DOWS unit is sealed from fluid communication from the portion of the interior downhole from the downflowing DOWS unit such that fluid in the second well bore cannot bypass the downflowing DOWS unit, and where the downflowing DOWS unit couples to a second water-rich outlet tube that extends downwards from the downflowing DOWS unit and traverses a second lower packer;

introducing a second hydrocarbon-rich outlet tube that extends from the surface directly to the downflowing DOWS unit, the second hydrocarbon-rich outlet tube being circumscribed by a second upper packer;

where each DOWS unit is operable to separate the production fluid into the water-rich fluid and the hydrocarbon-rich fluid;

the hydrocarbon-rich fluid of the upflowing DOWS unit passes to the surface through the first hydrocarbon-rich outlet tube so that the hydrocarbon-rich fluid remains within the first hydrocarbon-rich outlet tube from the time that the hydrocarbon-rich fluid is separated from the water-rich fluid until the hydrocarbon-rich fluid passes to the surface, such that only the water-rich fluid is located in an annular space between the first lower packer and the first upper packer; and the hydrocarbon-rich fluid of the downflowing DOWS unit passes to the surface through the second hydrocarbon-rich outlet tube so that the hydrocarbon-rich fluid remains within the second hydrocarbon-rich outlet tube from the time that the hydrocarbon-rich fluid is separated from the water-rich fluid until the hydrocarbon-rich fluid passes to the surface, such that only the production fluid is located in an annular space between the second upper packer and the second lower packer.

9. The method of claim 8 where each hydrocarbon-bearing formation has a permeability, and the difference between the permeability of the first hydrocarbon-bearing formation and the permeability of the second hydrocarbon-bearing formation is not significant.

10. The method of claim 8, wherein:

the upflowing DOWS unit is located entirely between a first upper packer and a first lower packer and couples to a first fluid inlet tube that extends downwards from the upflowing DOWS unit and traverses the first lower packer; and the downflowing DOWS unit is located entirely between a second upper packer and a second lower packer and couples to a second fluid inlet tube that extends upwards from the downflowing DOWS unit.

11. A Downhole Oil/Water Separation (DOWS) system that is operable for recovering a hydrocarbon-rich fluid from a plurality of hydrocarbon-bearing formations, the DOWS system comprising:

a first DOWS system well that has a first well bore wall that defines an interior, extends from a surface into a hydrocarbon-bearing reservoir such that it penetrates both a first hydrocarbon-bearing formation and a second hydrocarbon-bearing formation located within the hydrocarbon-bearing reservoir, has an upflowing DOWS unit located in the interior such that a portion of the well uphole from the upflowing DOWS unit is sealed from fluidly communicating with a portion of the well downhole from the upflowing DOWS unit such that fluid in the first well bore cannot bypass the upflowing DOWS unit and where the upflowing DOWS unit couples to a first fluid inlet tube that extends downwards from the upflowing DOWS unit and traverses a first lower packer, has a first hydrocarbon-rich outlet tube that extends from the surface directly to the upflowing DOWS unit, the first hydrocarbon-rich outlet tube being circumscribed by a first upper packer;

has an injection zone located uphole from the upflowing DOWS unit that is in fluid communication with both the first hydrocarbon-bearing formation and the upflowing DOWS unit, and has a production zone located downhole from the upflowing DOWS unit that is in fluid communication with both the second hydrocarbon-bearing formation and the upflowing DOWS unit; and a second DOWS system well that has a second well bore wall defines an interior, extends from the surface into the hydrocarbon-bearing reservoir such that it penetrates both the first hydrocarbon-bearing formation and the second hydrocarbon-bearing formation located within the hydrocarbon-bearing reservoir, has a downflowing DOWS unit located in the interior such that a portion of the well uphole from the downflowing DOWS unit is sealed from fluidly communicating with a portion of the well downhole from the downhole DOWS unit such that fluid in the second well bore cannot bypass the downflowing DOWS unit, where the downflowing DOWS unit is operable to separate a production fluid into the water-rich fluid and the hydrocarbon-rich fluid, and where the downflowing DOWS unit couples to a second water-rich outlet tube that extends downwards from the downflowing DOWS unit and traverses a second lower packer, has a second hydro-carbon rich outlet tube that extends from the surface directly to the downflowing DOWS unit, the second hydrocarbon-rich outlet tube being circumscribed by a second upper packer;

has an injection zone located downhole from the downflowing DOWS unit that is in fluid communication with both the second hydrocarbon-bearing formation and the downflowing DOWS unit, and has a production zone located uphole from the downflowing DOWS unit that is in fluid communication with both the first hydrocarbon-bearing formation and the upflowing DOWS unit;

where each DOWS system well is operable to pass the hydrocarbon-rich fluid to the surface, to draw the production fluid from one of the first hydrocarbon-bearing formation and the second hydrocarbon-bearing formation through the production zone and to inject a water-rich fluid into the other of the first hydrocarbon-bearing formation and the second hydrocarbon-bearing formation through the injection zone, where each of the upflowing DOWS unit and the downflowing DOWS unit is operable to separate a production fluid into the water-rich fluid and the hydrocarbon-rich fluid, where the first hydrocarbon-rich outlet tube is oriented to pass the hydrocarbon-rich fluid of the upflowing DOWS unit to the surface through the first hydrocarbon-rich outlet tube so that the hydrocarbon-rich fluid remains within the first hydrocarbon-rich outlet tube from the time that the hydrocarbon-rich fluid is separated from the water-rich fluid until the hydrocarbon-rich fluid passes to the surface, such that only the water-rich fluid is located in an annular space between the first lower packer and the first upper packer, where the second hydrocarbon-rich outlet tube is oriented to pass the hydrocarbon-rich fluid of the downflowing DOWS unit to the surface through the second hydrocarbon-rich outlet tube so that the hydrocarbon-rich fluid remains within the second hydrocarbon-rich outlet tube from the time that the hydrocarbon-rich fluid is separated from the water-rich fluid until the hydrocarbon-rich fluid passes to the surface, such that only the production fluid is located in an annular space between the second upper packer and the second lower packer, where each hydrocarbon-bearing formation has a permeability, where the second hydrocarbon-bearing formation is not in fluid communication with the first hydrocarbon-bearing formation except through the upflowing DOWS unit, and where the first hydrocarbon-bearing formation is not in fluid communication with the second hydrocarbon-bearing formation except through the downflowing DOWS unit.

12. The system of claim 11 where the difference between the permeability of the first hydrocarbon-bearing formation and the permeability of the second hydrocarbon-bearing formation is not significant.

13. The system of claim 11 further comprising an electric submersible pump (ESP).

14. The system of claim 13 where the ESP is located in the injection zone located downhole from the downflowing DOWS unit and is operable to inject the water-rich fluid into the second hydrocarbon-bearing formation.

15. The system of claim 13 where the ESP is located in the injection zone located uphole from the upflowing DOWS unit and is operable to inject the water-rich fluid into the first hydrocarbon-bearing formation.

16. The system of claim 13 where the ESP is located in the production zone located uphole from the downflowing DOWS unit and is operable to pass hydrocarbon-rich fluid to the surface.

17. The system of claim 11 further comprising a control system.

18. The system of claim 17 where the control system is operable to monitor a flow rate of the hydrocarbon-rich fluid produced from one of the first DOWS system well and the second DOWS system well.

19. The system of claim 17 where the control system is operable to monitor a flow rate of the water-rich fluid injected from one of the upflowing DOWS unit and the downflowing DOWS unit.

20. The system of claim 17 where the control system is operable to monitor a pressure within the injection zone for one of the first DOWS system well and the second DOWS system well.

21. The system of claim 17 further comprising an ESP, where the control system is operable to control the operation of the ESP.

22. The system of claim 17 where the control system is operable to monitor a water quality of the hydrocarbon-rich fluid passed to the surface.

23. The system of claim 11, wherein:

the upflowing DOWS unit is located entirely between a first upper packer and a first lower packer and couples to a first fluid inlet tube that extends downwards from the upflowing DOWS unit and traverses the first lower packer; and the downflowing DOWS unit is located entirely between a second upper packer and a second lower packer and couples to a second fluid inlet tube that extends upwards from the downflowing DOWS unit.

* * * * *